US009014406B2

(12) United States Patent
Thomsen et al.

(10) Patent No.: US 9,014,406 B2
(45) Date of Patent: Apr. 21, 2015

(54) METHOD FOR CONTROLLING A BINAURAL HEARING AID SYSTEM AND BINAURAL HEARING AID SYSTEM

(75) Inventors: Anders Højsgaard Thomsen, Smørum (DK); Thomas Kaulberg, Smørum (DK); Hong Suong Han, Smørum (DK)

(73) Assignee: Oticon A/S, Smorum (DK)

( * ) Notice: Subject to any disclaimer, the term of this patent is extended or adjusted under 35 U.S.C. 154(b) by 1073 days.

(21) Appl. No.: 13/046,854

(22) Filed: Mar. 14, 2011

(65) Prior Publication Data

US 2011/0249823 A1 Oct. 13, 2011

Related U.S. Application Data

(60) Provisional application No. 61/321,531, filed on Apr. 7, 2010.

(30) Foreign Application Priority Data

Apr. 7, 2010 (EP) ..... 10159223

(51) Int. Cl.
*H04R 25/00* (2006.01)

(52) U.S. Cl.
CPC ..... *H04R 25/552* (2013.01); *H04R 25/356* (2013.01); *H04R 2225/43* (2013.01)

(58) Field of Classification Search
CPC ..... H04R 25/356; H04R 25/552; H04R 2225/39; H04R 2225/41; H04R 2225/43
USPC ..... 381/57, 94.2, 94.3, 317, 320, 321
See application file for complete search history.

(56) References Cited

U.S. PATENT DOCUMENTS 5,544,250 A * 8/1996 Urbanski ..... 381/94.3
7,206,421 B1 * 4/2007 Taenzer ..... 381/119

(Continued)

FOREIGN PATENT DOCUMENTS

WO WO 2006/105664 A1 10/2006
WO WO 2008/138365 A1 11/2008

OTHER PUBLICATIONS

Wittkop, T. and Hohmann, V. (2003). "Strategy-Selective Noise Reduction for Binaural Digital Hearing Aids," Speech Communication, vol. 39, pp. 111-138.*

*Primary Examiner* — Duc Nguyen
*Assistant Examiner* — Kile Blair
(74) *Attorney, Agent, or Firm* — Birch, Stewart, Kolasch & Birch, LLP

(57) ABSTRACT

Level compression applied to the acoustic signals (18) received by a binaural hearing aid system (1) counteracts the preservation of inter-aural level differences (ILD) and thereby reduces the user's ability to locate the sound source and consequently his or her ability to understand speech in noisy environments. It is therefore known to increase the gain (57) in the hearing aid (2) receiving the louder signal and/or decreasing the gain (58) in the hearing aid (3) receiving the quieter signal, which at least in part allows for preserving the ILDs. However, in some situations this instead reduces the user's ability to understand speech, e.g. when acoustic noise is received at one ear (4) at a higher level (53, 54) than simultaneous speech at the other ear (5). The present invention overcomes this problem by decreasing the gain (57) in the hearing aid (2) receiving the louder signal and/or increasing the gain (58) in the hearing aid (3) receiving the quieter signal, when the difference between the noise-floor levels (55, 56) of the two hearing aids (2, 3) increases.

21 Claims, 5 Drawing Sheets

(56) References Cited

U.S. PATENT DOCUMENTS 7,630,507 B2 * 12/2009 Kates ..... 381/312
2004/0252852 A1 12/2004 Taenzer
2012/0128164 A1 * 5/2012 Blamey ..... 381/28

* cited by examiner

METHOD FOR CONTROLLING A BINAURAL HEARING AID SYSTEM AND BINAURAL HEARING AID SYSTEM

This nonprovisional application claims the benefit of U.S. Provisional Application No. 61/321,531 filed on Apr. 7, 2010 and to Patent Application No. 10159223.6 filed in Europe, on Apr. 7, 2010. The entire contents of all of the above applications is hereby incorporated by reference.

TECHNICAL FIELD

The present invention relates to a method for controlling a binaural hearing aid system and to a binaural hearing aid system. More specifically, the present invention relates to a method for controlling acoustic gains in a hearing aid system, which receives acoustic signals from an individual's surroundings, performs binaural processing of the acoustic signals and provides the processed signals to the individual's ears, and to a hearing aid system adapted to executing such method.

The invention may e.g. be useful in applications such as compensating for a hearing-impaired individual's loss of hearing capability or augmenting a normal-hearing individual's hearing capability.

BACKGROUND ART

The main purpose of a hearing aid is normally to amplify received acoustic signals in order to make them audible to the user of the hearing aid. In order to maintain the amplified signals within the user's "comfortable dynamic range", i.e. the amplitude range between the quietest and the loudest comfortably audible signals, hearing aids typically apply a level compression to the acoustic signals so that louder signals are amplified less than quieter signals. Level compression is particularly useful for hearing-impaired individuals, which typically have a smaller comfortable dynamic range than normal-hearing individuals. In modern digital hearing aids, the level compression is typically achieved in that the hearing aid monitors the level of the received acoustic signals and controls the acoustic gain of the hearing aid in dependence on the signal level. EP1491068B discloses an example of such a hearing aid.

A constant challenge for hearing-aid manufacturers is to help the hearing aid user improve his or her ability to understand speech in noisy environments. A known improvement in this direction is to have the hearing aids preserve spatial hearing cues in the acoustic signals, i.e. information that helps the user in determining the spatial origin of different acoustic signals. Among the most important spatial hearing cues are inter-aural level differences (ILD), i.e. differences in received levels at the two ears for acoustic signals originating from a single source. ILDs are caused by the so-called shadow effect of the user's head and are mainly used for sound source localisation at frequencies above about 1 kHz. The shadow effect causes acoustic signals arriving from the side of the head to be received at a higher level at the ear facing the source than at the respective opposite ear. An individual, who on both ears wears prior art hearing aids like the ones described further above, will, however, perceive reduced ILDs, since louder acoustic signals are amplified less than quieter acoustic signals. This effect of the level compression may reduce the user's ability to determine the spatial origin of acoustic signals and may thus also reduce the user's ability to understand speech in noisy environments.

This is a known problem, and the recent upcoming of binaural hearing aid systems, i.e. hearing aid systems comprising two hearing aid devices, which communicate with each other via a wired or wireless connection, allows binaural processing, i.e. a coordinated audio processing in the two hearing aid devices, and thus allows counteracting the above described reduction of the ILDs. At least one such method is known, which comprises monitoring the acoustic receiving levels at each of the ears as well as increasing the acoustic gain in the hearing aid receiving the louder signal and/or decreasing the acoustic gain in the hearing aid receiving the quieter signal. This method allows for preserving the ILDs—at least in part.

DISCLOSURE OF INVENTION

Thorough analysis of binaural hearing aid systems incorporating the above described method of counteracting the undesired reduction of the ILDs as well as tests involving users wearing such hearing aid systems have shown that the method in some situations undesirably—and contrary to the intention of applying the method—reduces the user's ability to understand speech. This mainly occurs when acoustic noise is received at one ear at a higher level than simultaneous speech at the other ear, e.g. when a truck engine is running close-by to the left of the user, while a person speaks to the right of the user. In this situation, applying the above described method of preserving the ILDs causes the louder noise signal originating from the truck to be amplified more than without the ILD preservation, which makes the quieter speech signal even more difficult to hear and understand.

It is an object of the present invention to provide a method for controlling a binaural hearing aid system, which overcomes the above problem. It is a further object of the present invention to provide a binaural hearing aid system, which does not suffer from the above problem.

These and other objects of the invention are achieved by the invention described in the accompanying independent claims and as described in the following. Further objects of the invention are achieved by the embodiments defined in the dependent claims and in the detailed description of the invention.

It is intended that the structural features of the system described below, in the detailed description of "mode(s) for carrying out the invention" and in the claims can be combined with any methods disclosed herein, when appropriately substituted by a corresponding process. Embodiments of such methods have the same advantages as the corresponding systems.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF THE DRAWINGS

The invention is explained in more detail below in connection with preferred embodiments and with reference to the drawings in which:

FIGS. 4 to 6 serve as illustrations of the functioning of the binaural hearing aid system of FIGS. 1 to 3 and as illustrations of preferred embodiments of the method according to the invention.

The figures are schematic and simplified for clarity, and they just show details, which are essential to the understanding of the invention, while other details are left out. Throughout, like reference numerals and/or names are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1:
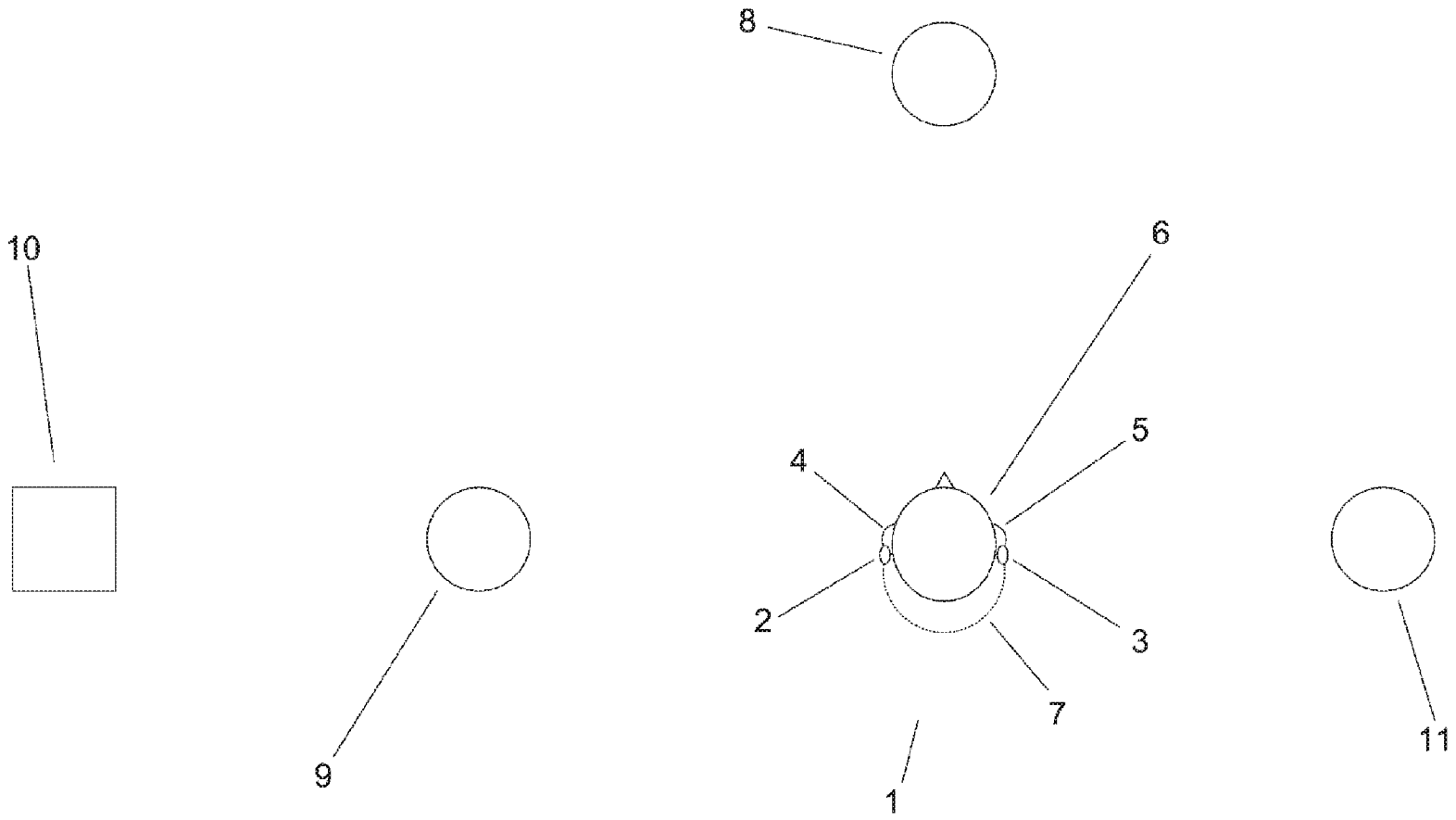
FIG. 1 shows a first embodiment of a binaural hearing aid system according to the invention.

The binaural hearing aid system 1 shown in FIG. 1 comprises two hearing aids 2, 3 located respectively at the left ear 4 and the right ear 5 of a hearing-aid user 6 and interconnected by a wireless communication channel 7. A first person 8 is located in front of the user 6. A second person 9 and a truck 10 are located to the left of the user 6. A third person 11 is located to the right of the user 6.

In the following description of the binaural hearing aid system 1 and the hearing aids 2, 3, the term "local" refers to components, properties, signals etc. of the particular hearing aid 2, 3 currently being described, whereas the term "remote" refers to such entities of the respective other hearing aid 2, 3. The same applies mutatis mutandis to the ears 4, 5.

Figure 2:
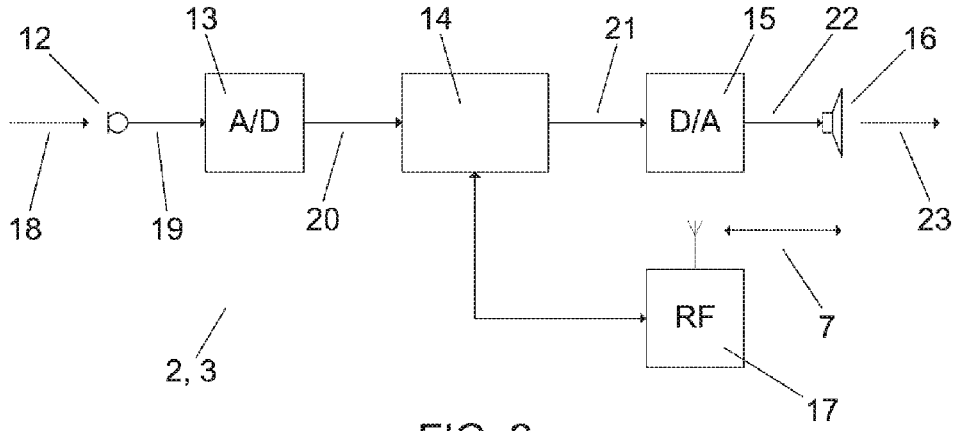
FIG. 2 shows a hearing aid comprised in the binaural hearing aid system of FIG. 1.

In order to simplify the following description, the hearing aids 2, 3 are assumed to be identical, and each of them comprises, as shown in FIG. 2, a microphone 12, an analog-to-digital converter 13, a processor 14, a digital-to-analog converter 15, a speaker 16 and a radio transceiver 17. The microphone 12 is arranged to receive an acoustic input signal 18 from the user's environment and is adapted to provide an analog input signal 19. The analog-to-digital converter 13 is connected to receive the analog input signal 19 and is adapted to provide a digital input signal 20. The processor 14 is connected to receive the digital input signal 20 and is adapted to provide a digital processed signal 21. The digital-to-analog converter 15 is connected to receive the digital processed signal 21 and is adapted to provide an analog output signal 22. The speaker 16 is connected to receive the analog output signal 22 and is arranged to radiate an acoustic output signal 23 into the user's ear canal. The processor 14 is further connected to receive and transmit information from and to the radio transceiver 17, which is adapted to provide a communication channel 7 to the remote hearing aid 2, 3.

Figure 3:
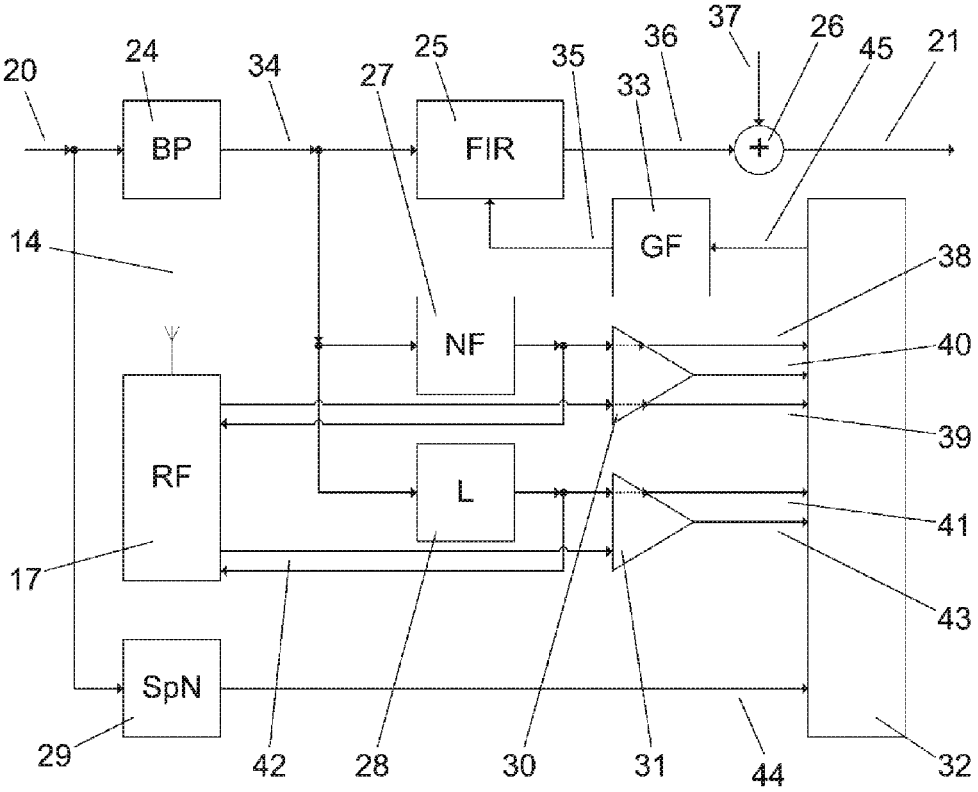
FIG. 3 shows a processor comprised in the hearing aid of FIG. 2.

The processor 14, which is shown in FIG. 3, comprises a band-pass filter 24, a programmable filter 25, an adder 26, a noise-floor detector 27, a level detector 28, a speech-to-noise detector 29, a noise comparator 30, a level comparator 31, a level controller 32 and a gain controller 33. The band-pass filter 24 is connected to receive the digital input signal 20 and is adapted to provide a band-limited input signal 34. The programmable filter 25 is connected to receive the band-limited input signal 34 as well as a gain setting and is adapted to provide a filtered output signal 36. The adder 26 is connected to receive the filtered output signal 36 as well as other signals 37 and is adapted to provide the digital processed signal 21. The noise-floor detector 27 is connected to receive the band-limited input signal 34 and is adapted to provide a local noise-floor indication 38. The radio transceiver 17 is connected to receive the local noise-floor indication 38 and is adapted to exchange data with the remote hearing aid 2, 3 via the communication channel 7 as well as to provide a remote noise-floor indication 39. The noise comparator 30 is connected to receive the local noise-floor indication 38 as well as the remote noise-floor indication 39 and is adapted to provide a noise-floor difference indication 40. The level detector 28 is connected to receive the band-limited input signal 34 and is adapted to provide a local level indication 41. The radio transceiver 17 is connected to receive the local level indication 41 and is further adapted to provide a remote level indication 42. The level comparator 31 is connected to receive the local level indication 41 as well as the remote level indication 42 and is adapted to provide a level difference indication 43. The speech-to-noise detector 29 is connected to receive the digital input signal 20 and is adapted to provide a speech-to-noise indication 44. The level controller 32 is connected to receive the local noise-floor indication 38, the remote noise-floor indication 39, the noise-floor difference indication 40, the local level indication 41, the level difference indication 43 as well as the speech-to-noise indication 44 and is adapted to provide a modified level indication 45. The gain controller 33 is connected to receive the modified level indication 45 and is adapted to provide the gain setting 35.

The processor 14 is preferably implemented as digital circuits operating in the discrete time domain, but any or all parts hereof may alternatively be implemented as analog circuits operating in the continuous time domain.

Although shown and described as distinct components, the functional blocks of the processor 14 may be implemented in any suitable combination of hardware, firmware and software and/or in any suitable combination of hardware units. As an example, the level controller 32 may be part of the gain controller 33. Furthermore, any single hardware unit may perform the operations of several functional blocks in parallel or in interleaved sequence and/or in any suitable combination thereof.

Also, except for the microphone 12, the speaker 16 and the radio transceiver 17, any combination of the components, functional blocks and processors 14 shown as parts residing in each of the hearing aids 2, 3 may alternatively reside in an arbitrary one of the hearing aids 2, 3 or in a third device, such as e.g. a streamer unit for streaming sound signals from a television set to the hearing aids 2, 3, and the particular hearing aid 2, 3 or device may then perform the corresponding function(s) of both hearing aids 2, 3. The radio transceivers 17 may be further adapted to use the communication channel 7 for exchanging further signals and information required for such distributed processing.

Further modifications obvious to the skilled person may be made to the disclosed method and system without deviating from the spirit and scope of the invention. In this description, any such modifications are mentioned in a non-limiting way.

Figure 4:
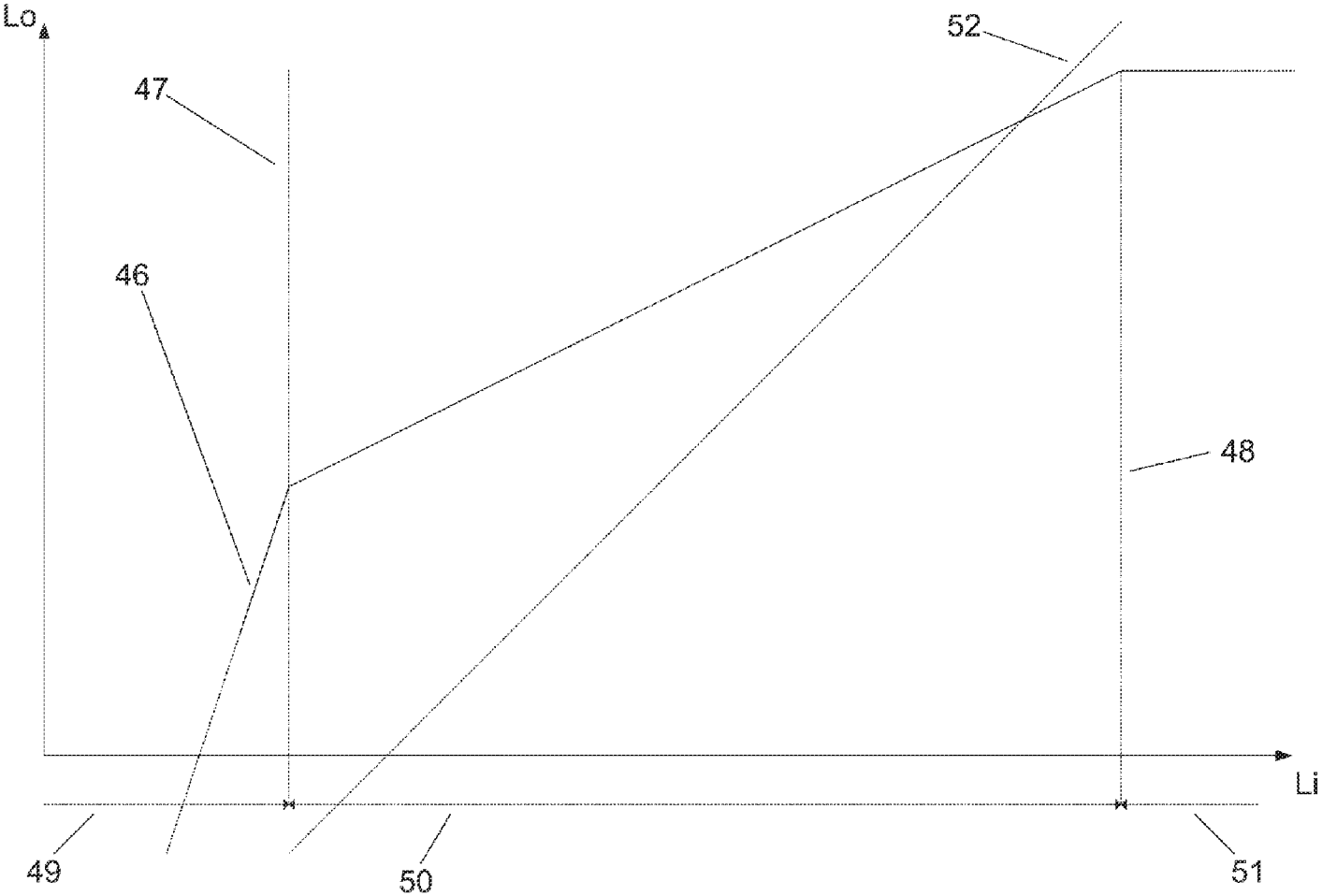
FIG. 4 shows an input/output function used by the processor of FIG. 3.

FIG. 4 shows in double-logarithmic scale an example input/output function 46, which yields an acoustic output level Lo in dependence on an acoustic input level Li. The slope of the curve 46 equals the compression factor, which is level-dependent. A lower level threshold 47 and an upper level threshold 48 divide the input level axis Li into an expansion range 49 below the lower level threshold 47, a compression range 50 between the lower and upper level thresholds 47, 48 and a limitation range 51 above the upper level threshold 48. The dotted line 52 represents unity gain, i.e. the points where the acoustic output level Lo equals the acoustic input level Li. A gain function GF (not shown) yielding the acoustic gain in dependence on the acoustic input level Li may be derived from the input/output function 46 by subtracting the acoustic input level Li from the acoustic output level Lo. In other words, the acoustic gain for a specific acoustic input level Li equals the vertical distance between the input/output function 46 and the unity gain curve 52. Within the expansion range 49, the slope of the input/output function 46 is greater than unity so that the gain increases with increasing acoustic input level Li, which corresponds to a level expansion. Within the compression and limitation ranges 50, 51, the slope is less than unity so that the gain decreases with increasing acoustic input level Li, which corresponds to a level compression. The gain function GF is used by the gain controller 33 to compute the gain setting 35. Alternatively, the gain function GF may be inherently defined by any other method that the gain controller 33 uses to compute the gain setting 35. In the following, the acoustic gain defined by the gain function GF is referred to as the default acoustic gain G, and the level compression implied by the gain function GF is referred to as the default level compression. Actually implemented gain functions GF are normally frequency-dependent, but in order to simplify the description, it is assumed that the example gain function GF applies to all frequencies within the pass-band of the band-pass filter 24. For the same reason, it is further assumed that the gain functions GF of the local and the remote hearing aids 2, 3 are identical, even though they may deviate substantially from each other in an actual binaural hearing aid system 1.

Figure 5:
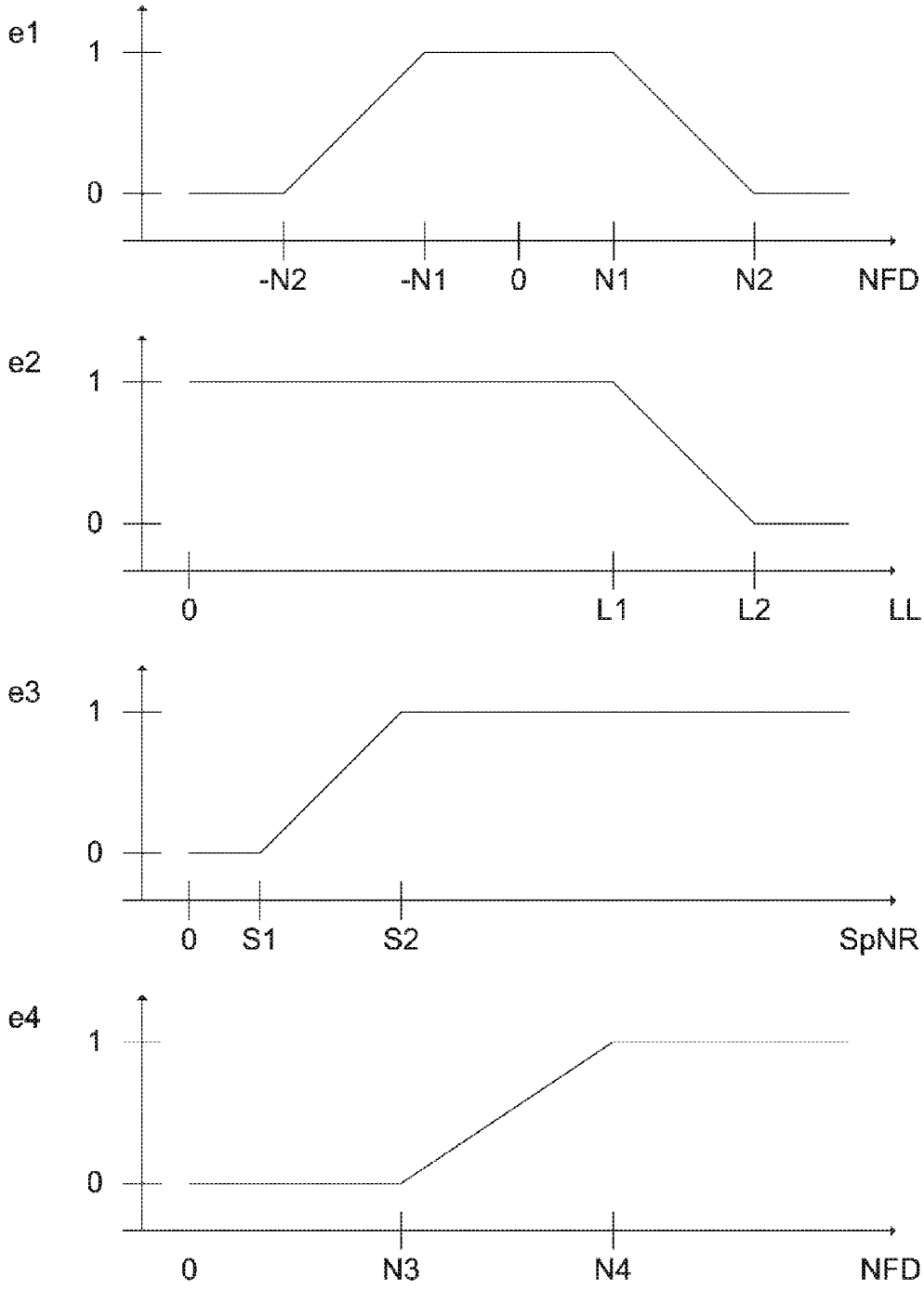
FIG. 5 shows four enabling functions used by the processor of FIG. 3.

FIG. 5 shows four example enabling functions e1, e2, e3, e4 used by the level controller 32. The abscissa axes NFD, LL, SpNR are logarithmic and the ordinate axes e1, e2, e3, e4 are linear.

Figure 6:
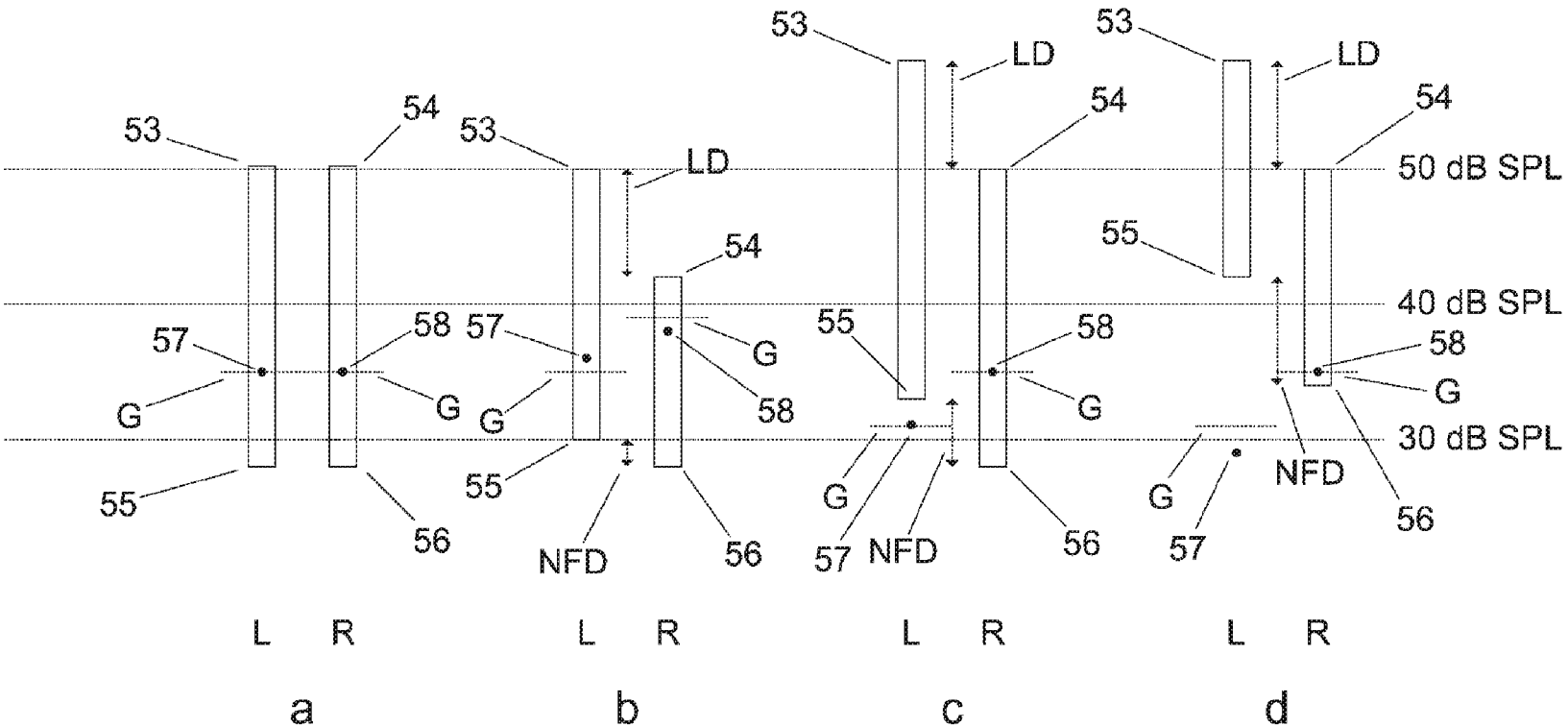
FIG. 6 shows example signal levels and acoustic gains.

FIG. 6 shows in logarithmic scale example acoustic signal levels 53, 54, example noise-floor levels 55, 56, example default acoustic gains G and example actual acoustic gains 57, 58 for the left ear L as well as for the right ear R in four example receiving situations a, b, c, d.

In the following, the functioning of the first embodiment of the binaural hearing aid system of FIGS. 1 to 3 as well as the use of embodiments of the method according to the invention are explained with further reference to FIGS. 4 to 6. The functional description also explains further details of FIGS. 4 to 6. All references to gains, levels and thresholds are logarithmic, i.e. in dB.

In the hearing aid 2, 3, the microphone 12 receives the acoustic input signal 18 and converts it into the analog input signal 19, which is digitised by the analog-to-digital converter 13 to form the digital input signal 20. The band-pass filter 24 forms the band-limited input signal 34 by removing undesired low-frequency and high-frequency content from the digital input signal 20. The programmable filter 25 is a finite-impulse-response (FIR) filter, which forms the filtered output signal 36 by applying a frequency-dependent gain to the band-limited input signal 34. The applied gain is controlled by the gain setting 35, which preferably comprises a set of filter coefficients. The adder 26 forms the digital processed signal 21 by adding the resulting filtered output signal 36 to the other signals 37. The digital-to-analog converter 15 converts the digital processed signal 21 into the analog output signal 22, which the speaker 16 converts further into the acoustic output signal 23. During an initial fitting of the hearing aid system 1, the frequency response of the programmable filter 25 of each hearing aid 2, 3 is individually adapted to the hearing thresholds of the respective local ear 4, 5 of the user 6 in order to achieve an acoustic gain between the acoustic input signal 18 and the acoustic output signal 23 that allows the hearing aid 2, 3 to compensate for the user's hearing loss on the respective local ear 4, 5.

The amplitude of the acoustic input signal 18 is modulated, e.g. when speech is received. The noise-floor detector 27 determines a noise-floor level of the acoustic input signal 18 by determining the amplitude minima in the band-limited input signal 34 and outputs the result in the local noise-floor indication 38. The level detector 28 determines a signal level of the acoustic input signal 18 by performing a root-mean-square (RMS) averaging of the signal amplitude of the band-limited input signal 34 and outputs the result in the local level indication 41. The speech-to-noise detector 29 determines the amplitude minima and maxima in the digital input signal 20, subtracts the minima from the maxima and provides the resulting broadband speech-to-noise ratio in the speech-to-noise indication 44. The radio transceiver 17 transmits the local noise-floor level indication 38 to the remote hearing aid 2, 3 and receives the remote noise-floor level indication 39 from the remote hearing aid 2, 3 via the communication channel 7. The noise comparator 30 compares the local noise-floor level 38 to the remote noise-floor level 39 and outputs the resulting noise-floor level difference in the noise-floor difference indication 40, a positive difference 40 indicating that the local noise-floor level 38 exceeds the remote noise-floor level 39. The radio transceiver 17 transmits the local signal level indication 41 to the remote hearing aid 2, 3 and receives the remote signal level indication 42 from the remote hearing aid 2, 3 via the communication channel 7. The level comparator 31 compares the local signal level 41 to the remote signal level 42 and outputs the resulting signal level difference in the level difference indication 43, a positive difference 43 indicating that the local signal level 41 exceeds the remote signal level 42. The level controller 32 computes a modified signal level as explained in further detail below and provides it in the modified level indication 45. The gain controller 33 computes the gain setting 35 so that the acoustic gain of the hearing aid 2, 3 substantially equals the gain provided by the gain function GF, however assuming that the acoustic input level Li equals the modified signal level 45. Thus, within the compression and limitation ranges 50, 51, increasing the modified signal level 45 above the local signal level 41 causes the gain controller 33 to output a gain setting 35 that results in an acoustic gain below the default acoustic gain G and vice versa. In some situations, the gain controller 33 may however modify the gain setting 35 as explained in further detail below.

The level controller 32 computes the modified signal level 45 according to the following equation:

$$LM=LL-M1,$$

wherein:

LM is the modified signal level 45,

LL is the local signal level 41, and

M1 is a first modifier term defined by:

$$M1=\alpha\cdot LD\cdot\min(e1(NFD),e2(LL),e3(SpNR)),$$

wherein:

α is a positive constant,

LD is the signal level difference 43, the min function yields the lower value of the three arguments, NFD is the noise-floor difference 40, SpNR is the broadband speech-to-noise ratio 44, and the enabling functions e1, e2, e3 (see FIG. 5) are defined by:

| | |
|---|---|
| e1 = 1 | for \|NFD\| < N1, |
| e1 = (N2 − \|NFD\|)/(N2 − N1) | for N1 ≤ \|NFD\| < N2, |
| e1 = 0 | for N2 ≤ \|NFD\|, |
| e2 = 1 | for LL < L1, |
| e2 = (L2 − LL)/(L2 − L1) | for L1 ≤ LL < L2, |
| e2 = 0 | for L2 ≤ LL, |
| e3 = 0 | for SpNR < S1, |
| e3 = (SpNR − S1)/(S2 − S1) | for S1 ≤ SpNR < S2, and |
| e3 = 1 | for S2 ≤ SpNR. |

The enabling functions e1, e2, e3 serve to selectively enable or disable the first modifier term M1. The enabling functions e1, e2, e3 are continuous and each of them is enabling when the function value is 1 and disabling when the function value is 0. In the transition ranges between enabling and disabling, each function value varies linearly between 0 and 1 in order to avoid sudden changes in the behaviour of the hearing aid 2, 3. Each pair of thresholds, i.e. N1-N2, L1-L2 and S1-S2, thus constitutes a "soft" threshold, which causes a gradual transition between enabling and disabling.

In the following, it is assumed that the acoustic input levels LL, 41 at both hearing aids 2, 3 are within the compression range 50.

Provided that each of the three enabling functions e1, e2, e3 is not disabling, the first modifier term M1 causes a decrease of the modified signal level 45 and thus an increase of the local acoustic gain when the local signal level 41 exceeds the remote signal level 42, and vice versa. In the binaural hearing aid system 1, the hearing aid 2, 3 receiving the louder signal 18 thus increases its acoustic gain, whereas the hearing aid 2, 3 receiving the quieter signal 18 decreases its acoustic gain. This counteracts the effect of the level compression described above in connection with the prior art, and the first modifier term M1 thus allows for preserving ILDs. The increase or decrease of the modified signal level 45 is proportional to the signal level difference LD, 43.

The first enabling function e1 disables the first modifier term M1 when the absolute value of the noise-floor difference |NFD|, 40 increases above a threshold N1, N2, which indicates that the acoustic input signals 18 received by the two hearing aids 2, 3 mainly comprise signals from different sources 9, 10, 11, and that the signal level difference 43 thus unlikely reflects the ILD. In this case, preservation of ILDs is generally not likely to succeed using the methods described above. The second enabling function e2 disables the first modifier term M1 when the local acoustic input level LL increases above a threshold L1, L2, above which further amplification of the local acoustic input signal 18 would likely cause a limitation or a distortion of the local acoustic output signal 23. The third enabling function e3 disables the first modifier term M1 when the local speech-to-noise ratio SpNR, 43 decreases below a threshold S1, S2, below which attempting to preserve the ILD is more likely to disturb than aid the user 6 in understanding speech.

The gain controller 33 computes the gain setting 35 according to the following equation:

$$GS=GF(LM)-M2,$$

wherein:

GS is the gain setting 35,

GF is the gain function,

LM is the modified signal level 45, and

M2 is a second modifier term defined by:

$$M2=\beta\cdot e4(NFD),$$

wherein:

β is a positive constant,

NFD is the noise-floor difference 40, and the enabling function e4 (see FIG. 5) is defined by:

| | |
|---|---|
| e4 = 0 | for NFD < N3, |
| e4 = (NFD − N3)/(N4 − N3) | for N3 ≤ NFD < N4, and |
| e4 = 1 | for N4 ≤ NFD. |

The enabling function e4 serves to selectively enable or disable the second modifier term M2. The enabling function is continuous and is enabling when the function value is 1 and disabling when the function value is 0. In the transition ranges between enabling and disabling, the function value varies linearly between 0 and 1 in order to avoid sudden changes in the behaviour of the hearing aid 2, 3. The thresholds, N3-N4, thus together constitute a "soft" threshold, which causes a gradual transition between enabling and disabling.

The second modifier term M2 causes a decrease of the local acoustic gain GS when the noise-floor difference NFD, 40 increases above a threshold N3, N4, which indicates that the local ear 4 faces a loud noise source 10. In this case, an attenuation of the local acoustic input signal 18 is likely to improve the user's 6 ability to understand speech comprised in the remote acoustic input signal 18. The second modifier term M2 thus allows for improving the user's 6 ability to understand speech received at one ear 5 simultaneously with a louder noise signal at the other ear 4. The decrease of the local acoustic gain GS is limited by the constant β.

The mentioned constants and thresholds are preferably selected among the following values:

α: 0.2 to 0.5, more preferably around 0.25,

β: 3 to 10 dB, more preferably around 4 dB,

N1: 1 to 5 dB, more preferably around 3 dB,

N2: 8 to 12 dB, more preferably around 10 dB,

L1: 50 to 70 dB, more preferably around 60 dB SPL,

L2: 70 to 90 dB, more preferably around 80 dB SPL,

S1: −12 to −6 dB, more preferably around −10 dB,

S2: 3 to 8 dB, more preferably around 5 dB,

N3: 3 to 7 dB, more preferably around 5 dB, and

N4: 8 to 16 dB, more preferably around 12 dB, where furthermore, preferably:

0≤N1≤N2,

0<L1≤L2,

S1≤S2,

N1≤N3,

N2≤N4, and

N3≤N4.

In the case that the pass-band of the band-pass filter 24 does not comprise all audible frequencies, the constants L1 and L2 should preferably be decreased correspondingly in order to avoid limitation or distortion of loud broadband signals 18.

The constants and thresholds may differ between the two hearing aids 2, 3, e.g. due to different hearing losses on the respective ears 4, 5.

In the example listening situations described below, the following example values of the constants are used:

α: 0.5,
β: 4 dB,
N1: 2 dB,
N2: 4 dB,
L1: 60 dB SPL,
L2: 80 dB SPL,
S1: −10 dB,
S2: 5 dB,
N3: 6 dB, and
N4: 10 dB.

Furthermore, it is assumed that the SpNR is greater than 5 dB, i.e. greater than S2, in all of the example listening situations.

In a first example listening situation, the person 8 in front of the user 6 is speaking in the absence of other acoustic sources 9, 10, 11. The speech signal 18 is thus received at both ears L, 4, R, 5 at substantially equal acoustic input levels LL, 53, 54 (see FIG. 6*a*), e.g. 50 dB SPL. In this situation, each of the hearing aids 2, 3 determines the local noise-floor level 38, 55, 56 and the local signal level LL, 41, 53, 54 to the same values as the remote hearing aid 2, 3. The level difference LD, 43 and, consequently, the first modifier term M1 are thus zero, so that the modified signal level LM, 45 equals the local signal level LL, 41, 53, 54. Similarly, the noise-floor difference NFD, 40, and thus the fourth enabling function e4 and the second modifier term M2, are also zero. In each of the hearing aids 2, 3, the gain controller 33 thus computes a gain setting GS, 35 that sets the acoustic gain 57, 58 of the hearing aid 2, 3 equal to the default acoustic gain G. In other words, the acoustic output level Lo equals the value yielded by the input/output function 46 when applied to the local input level LL, 53, 54, and the default level compression is thus applied.

In a second example listening situation, the person 9 to the left of the user 6 is speaking in the absence of other acoustic sources 8, 10, 11. The shadow effect causes the speech signal 18 to be received at a higher level 53, 54 (see FIG. 6*b*) at the left ear L, 4 than at the right ear R, 5. The left-ear hearing aid 2 thus determines the local signal level LL, 41, 53 at e.g. 50 dB SPL to be higher than the remote signal level 42, 54 at e.g. 42 dB SPL, and the level difference LD, 43, which corresponds to the ILD, is thus positive, e.g. 8 dB. Similarly, the left-ear hearing aid 2 determines the local noise-floor level 38, 55 at e.g. 30 dB SPL to be higher than the remote noise-floor level 39, 56 at e.g. 28 dB SPL, and the noise-floor difference NFD, 40 is thus also positive, e.g. 2 dB. The noise-floor difference NFD, 40 is equal to or less than both N1 and N3, the local signal level LL, 41, 53 is less than L1 and the local speech-to-noise ratio SpNR, 44 is greater than S2, so that the first modifier term M1 equals α·LD, e.g. 4 dB, which is positive, and the second modifier term M2 equals zero. The modified signal level LM, 45 thus equals the local signal level LL, 41, 53 minus α·LD, i.e. the modified signal level LM, 45 is decreased so that the gain controller 33 computes a gain setting 35 that sets the acoustic gain 57 of the left-ear hearing aid 2 to a value above the default acoustic gain G of the left-ear hearing aid 2. In the right-ear hearing aid 3, however, the local signal level LL, 41, 54 is less than the remote signal level 42, 53, the level difference LD, 43 is negative, e.g. −8 dB, the noise-floor difference NFD, 40 is negative, e.g. −2 dB, the first modifier term M1 is negative, e.g. −4 dB, and the second modifier term M2 equals zero. In the right-ear hearing aid 3, the modified signal level LM, 45 is thus increased so that the gain controller 33 computes a gain setting 35 that sets the acoustic gain 58 of the right-ear hearing aid 3 to a value below the default acoustic gain G of the right-ear hearing aid 3. Since the right-ear hearing aid 3 receives a quieter acoustic signal 18 than in the first example listening situation, the default level compression now prescribes an increased default acoustic gain G of the right-ear hearing aid 3, which would reduce the perceived ILD. The first modifier term M1, however, causes the left-ear hearing aid 2 receiving the louder acoustic signal 18 to increase the gain 57, and the right-ear hearing aid 3 receiving the quieter acoustic signal 18 to decrease the gain 58, which increases the level difference between the acoustic output signals 23 and thus at least in part preserves the ILD. In other words, the first modifier term M1 decreases the compression factor. Preferably, the acoustic gain 57, 58 is faded towards the default acoustic gain G when a hearing aid 2, 3 detects that communication with the remote hearing aid 2, 3 is interrupted.

In a third example listening situation, the person 9 to the left of the user 6 is speaking at a high voice level, while the person 11 to the right of the user 6 is speaking at a normal voice level. The acoustic input level 53 at the left-ear hearing aid 2, e.g. 58 dB SPL, is thus higher than the acoustic input level 54 at the right-ear hearing aid 3, e.g. 50 dB SPL (see FIG. 6*c*). Like in the second example listening situation, the left-ear hearing aid 2 determines the local signal level LL, 41, 53 to be higher than the remote signal level 42, 54, and the level difference LD, 43 is thus positive, e.g. 8 dB. Similarly, the left-ear hearing aid 2 determines the local noise-floor level 38, 55 at e.g. 33 dB SPL to be higher than the remote noise-floor level 39, 56 at e.g. 28 dB SPL, and the noise-floor difference NFD, 40 at e.g. 5 dB is thus also positive, however greater than in the second example listening situation. The noise-floor difference NFD, 40 is now less than N3, but greater than N2, while the local signal level LL, 41, 53 is less than L1 and the local speech-to-noise ratio SpNR, 44 is greater than S2. Correspondingly, the first enabling function e1 is now disabling, and the first modifier term M1 thus equals zero. The second modifier term M2 also equals zero. The modified signal level LM, 45 thus equals the local signal level LL, 41, 53 so that the gain controller 33 computes a gain setting 35 that sets the acoustic gain 57 of the left-ear hearing aid 2 equal to the default acoustic gain G of the left-ear hearing aid 2. In the right-ear hearing aid 3, the noise-floor difference NFD, 40 at e.g. −5 dB also causes the first modifier term M1 to equal zero, and the gain controller 33 thus computes a gain setting 35 that sets the acoustic gain 58 of the right-ear hearing aid 3 equal to the default acoustic gain G of the right-ear hearing aid 3. In this situation, the increased noise-floor difference NFD, 40 is taken as an indication that the acoustic input signals 18 at the two hearing aids 2, 3 originate from different acoustic sources 9, 11, so that preservation of the ILD based on the received acoustic input levels 53, 54 alone is unlikely to succeed. Consequently, the default level compression is applied in both hearing aids 2, 3. Note that the default acoustic gains G for both hearing aids 2, 3 are less than in the second example listening situation due to the increased acoustic input levels 53, 54.

The second and third enabling functions e2, e3 have similar effects on the acoustic gains 57, 58, but their effects in the left-ear and right-ear hearing aids 2, 3 are weaker correlated than the effects of the first enabling function e1. When one of the hearing aids 2, 3 determines the local acoustic input level 53, 54 to be above the threshold L1, L2, the second enabling function e2 disables the first modifier term M1 and thus prevents the local modified signal level LM, 45 from decreasing below the local signal level LL, 41, 53. Consequently, the gain controller 33 is prevented from computing a gain setting 35 that sets the acoustic gain 57, 58 of the corresponding hearing aid 2, 3 above the default acoustic gain G. Similarly, when one of the hearing aids 2, 3 determines the local speech-to-noise ratio SpNR, 44 to be below the threshold S1, S2, the third enabling function e3 disables the first modifier term M1 and thus prevents the gain controller 33 from computing a gain setting 35 that sets the acoustic gain 57, 58 of the corresponding hearing aid 2, 3 away from the default acoustic gain G.

In a fourth example listening situation, the engine of the close-by truck 10 is running and thus emits a noise signal, while the person 11 to the right of the user 6 is speaking at a normal voice level. The acoustic input level 53 at the left-ear hearing aid 2 and the acoustic input level 54 at the right-ear hearing aid 3 (see FIG. 6*d*) equal the corresponding levels in the third example listening situation, i.e. e.g. 58 dB SPL and 50 dB SPL, respectively. Also the local signal level LL, 41, the remote signal level 42 and the level difference LD, 43 are determined to the same values as in the third example listening situation, and consequently, the default acoustic gains G remain the same. The left-ear hearing aid 2, however, determines the local noise-floor level 38, 55 at e.g. 42 dB SPL to be higher than the remote noise-floor level 39, 56 at e.g. 34 dB SPL, and the noise-floor difference NFD, 40 at e.g. 8 dB is thus positive, however this time not only greater than in the third example listening situation, but also greater than both N2 and N3. The first enabling function e1 is thus disabling, the fourth enabling function e4 is partly enabling, e.g. with a factor of 0.5, and the first modifier term M1 equals zero, while the second modifier term M2 equals $\beta \cdot 0.5$, e.g. 2 dB. The modified signal level LM, 45 thus equals the local signal level LL, 41, 53, but the gain controller 33 computes a gain setting 35 that sets the acoustic gain 57 of the left-ear hearing aid 2 to a value $\beta \cdot 0.5$, e.g. 2 dB, below the default acoustic gain G of the left-ear hearing aid 2. In the right-ear hearing aid 3, the noise-floor difference NFD, 40 is determined to be negative, e.g. −8 dB, which causes the first modifier term M1 to equal zero. Due to the negative value of the noise-floor difference NFD, 40, the fourth enabling function e4 is disabling, and the second modifier term M2 thus also equals zero. The gain controller 33 thus computes a gain setting 35 that sets the acoustic gain 58 of the right-ear hearing aid 3 equal to the default acoustic gain G of the right-ear hearing aid 3. In this situation, the further increased noise-floor difference NFD, 40 is taken as an indication that the acoustic input signals 18 received by the left-ear hearing aid 2 primarily originates from a noise source 10 that may disturb the speech signal 18 primarily received by the right-ear hearing aid 3 and that should thus preferably be attenuated. Consequently, the default level compression is applied in the right-ear hearing aid 3, while an acoustic gain 57 lower than the default acoustic gain G is applied in the left-ear hearing aid 2. In other words, the second modifier term M2 increases the compression factor in the left-ear hearing aid 2. Preferably, the acoustic gain 57 in the left-ear hearing aid 2 is faded towards the default acoustic gain G when the left-ear hearing aid 2 detects that communication with the right-ear hearing aid 3 is interrupted.

The remote noise-floor level 39, 56 and/or the noise-floor difference NFD, 40, possibly in combination with other signal properties, are thus used as an indication of the character of the current listening situation, which allows for identifying specific listening situations and thus for adapting the acoustic gains (57, 58) to such specific listening situations.

The band-pass filter 24 may be part of a filter bank comprising at least two similar band-pass filters 24, which are adapted to separate the digital input signal 20 into a corresponding number of different components 34, each component 34 carrying a single frequency sub-band of the digital input signal 20. The binaural hearing aid system 1 may be further adapted to control the acoustic gain as described above separately for each frequency sub-band. The resulting additional filtered output signal(s) 36 may constitute the other signals 37 being added to the filtered output signal 36 in the adder 26, which thus combines all filtered output signals 36, 37 into a single broadband digital processed signal 21.

In alternative embodiments of the invention, separate values of a may be chosen respectively for positive and for negative signal level differences LD, 43. Also the thresholds N1-N2 may be chosen individually for positive and for negative signal level differences LD, 43. Furthermore, the enabling functions e1, e2, e3, e4 may be non-linear or non-continuous. Above, a preferred embodiment of the invention has been described, which is implemented by means of the enabling functions e1, e2, e3, e4 and the modifier terms M1, M2. However, many other ways of achieving the desired dependence of the acoustic gains 57, 58 on the identified listening situations may be readily envisaged by the skilled person without deviating from the scope of the invention.

Alternatively to a speaker 16, such as e.g. an electromagnetic speaker, an electrodynamic speaker or a piezoelectric transducer, the hearing aid 2, 3 may comprise as output means 16 an electrically driven vibrator for causing vibration of the user's cranial structure or a set of electrodes for stimulating e.g. the user's hearing nerve. In the first case, the output signal 23 of the hearing aid 2, 3, i.e. the vibrations of the cranial structure, are acoustic per definition, and the acoustic gain 57, 58 may be computed as the difference between an arbitrary level of the vibrations and the level of the acoustic input signal 18. In the second case, the output signal 23 is really electric and only virtually acoustic, and the acoustic gain 57, 58 may be computed as the difference between an arbitrary level of the electric output signal 23 and the level of the acoustic input signal 18, or alternatively, as the difference between a perceived sound level and the level of the acoustic input signal 18.

The communication channel 7 may be implemented as a wireless connection using e.g. radio-frequency, optic or acoustic signals, or as a wired connection. The connection may be established directly between the hearing aids 2, 3 or via intervening devices, such as e.g. a body-worn device, which may also serve as e.g. a streamer unit for streaming sound signals from a television set to the hearing aids 2, 3.

FEATURES OF THE INVENTION

The below described features of the invention may be combined arbitrarily in order to adapt the method and/or the system according to the invention to specific requirements.

A preferred embodiment of a method according to the invention may be usable for controlling a binaural hearing aid system 1 having a first and a second hearing aid 2, 3 interconnected via a communication channel 7, the first hearing aid 2 receiving a first acoustic input signal 18 and applying a first acoustic gain 57 to the first acoustic input signal 18 to provide a first acoustic or virtually acoustic output signal 23, the second hearing aid 3 receiving a second acoustic input signal 18 and applying a second acoustic gain 58 to the second acoustic input signal 18 to provide a second acoustic or virtually acoustic output signal 23. The method may comprise: determining a first noise-floor level 55 of the first acoustic input signal 18; determining a second noise-floor level 56 of the second acoustic input signal 18; controlling the first acoustic gain 57 in dependence on the second noise-floor level 56; and controlling the second acoustic gain 58 in dependence on the first noise-floor level 55. This may allow for improving identification of specific types of listening situations and thus for better adaptation of the acoustic gains 57, 58 to specific types of listening situations.

The method may further comprise: controlling the first acoustic gain 57 in further dependence on the first noise-floor level 55; and controlling the second acoustic gain 58 in further dependence on the second noise-floor level 56. This may allow for further improving identification of specific types of listening situations and thus for even better adaptation of the acoustic gains 57, 58 to specific types of listening situations.

The method may further comprise decreasing the first acoustic gain 57 in dependence on the second noise-floor level 56 decreasing. This may allow for reducing the disturbing influence of a noise signal 18 primarily received at one ear 4 on a speech signal 18 primarily received at the other ear 5.

The method may further comprise increasing the second acoustic gain 58 in dependence on the first noise-floor level 55 increasing. This may allow for further reducing the disturbing influence of a noise signal 18 primarily received at one ear 4 on a speech signal 18 primarily received at the other ear 5.

The method may further comprise decreasing the first acoustic gain 57 in further dependence on the first noise-floor level 55 increasing. This may allow for further reducing the disturbing influence of a noise signal 18 primarily received at one ear 4 on a speech signal 18 primarily received at the other ear 5.

The method may further comprise maintaining the second acoustic gain 58 in dependence on the first noise-floor level 55 exceeding the second noise-floor level 56 by more than a first predefined threshold N3, N4. This may allow for further reducing the disturbing influence of a noise signal 18 primarily received at one ear 4 on a speech signal 18 primarily received at the other ear 5.

The method may further comprise: determining a first signal level 53 of the first acoustic input signal 18; determining a second signal level 54 of the second acoustic input signal 18; decreasing the first acoustic gain 57 in further dependence on the first signal level 53 increasing; and decreasing the second acoustic gain 58 in dependence on the second signal level 54 increasing. This may allow for applying a level compression to the acoustic input signals 18.

The method may further be applied in dependence on the first signal level 53 exceeding the second signal level 54. This may allow for further reducing the disturbing influence of a noise signal 18 primarily received at one ear 4 on a speech signal 18 primarily received at the other ear 5.

The method may further comprise increasing the first acoustic gain 57 in further dependence on the second signal level 54 decreasing. This may allow for preserving ILDs—at least in part.

The method may further comprise increasing the first acoustic gain 57 in further dependence on the first noise-floor level 55 not exceeding the second noise-floor level 56 by more than a second predefined threshold N1, N2. This may prevent attempting to preserve ILDs when ILDs may not be appropriately determined.

The method may further comprise increasing the first acoustic gain 57 in further dependence on the first signal level 53 not exceeding a third predefined threshold L1, L2. This may prevent limiting and/or distortion of the acoustic output signal 23.

The method may further comprise decreasing the second acoustic gain 58 in further dependence on the first signal level 53 increasing. This may also allow for preserving ILDs—at least in part.

The method may further comprise decreasing the second acoustic gain 58 in further dependence on the first noise-floor level 55 not exceeding the second noise-floor level 56 by more than a fourth predefined threshold N1, N2. This may also prevent attempting to preserve ILDs when ILDs may not be appropriately determined.

The method may further comprise: determining a speech-to-noise ratio SpNR for the second acoustic input signal 18; and decreasing the second acoustic gain 58 in further dependence on the speech-to-noise ratio SpNR exceeding a fifth predefined threshold S1, S2. This may prevent making a speech signal 18 harder to understand.

The method may further comprise: separating each of the first and second acoustic input signals 18 into at least two different components 34, each component 34 carrying a single frequency sub-band of the respective acoustic input signal 18; and applying a method according to the invention to each component 34. This may allow for simultaneous processing of sound from several noise and signal sources that are separated in frequency.

A preferred embodiment of a binaural hearing aid system 1 according to the invention may comprise: a first hearing aid 2 adapted to receive a first acoustic input signal 18 and provide a first acoustic or virtually acoustic output signal 23; a second hearing aid 3 adapted to receive a second acoustic input signal 18 and provide a second acoustic or virtually acoustic output signal 23; a communication channel 7 interconnecting the first and second hearing aids 2, 3; a first programmable filter 25 adapted to process the first acoustic input signal 18 to achieve a first acoustic gain 57 of the first hearing aid 2; and a second programmable filter 25 adapted to process the second acoustic input signal 18 to achieve a second acoustic gain 56 of the second hearing aid 3, wherein the binaural hearing aid system 1 further comprises: a first noise-floor detector 27 adapted to determine a first noise-floor level 38, 55 of the first acoustic input signal 18; a second noise-floor detector 27 adapted to determine a second noise-floor level 38, 56 of the second acoustic input signal 18; a first gain controller 32, 33 adapted to control the first acoustic gain 57 in dependence on the second noise-floor level 38, 56; and a second gain controller 32, 33 adapted to control the second acoustic gain 58 in dependence on the first noise-floor level 38, 55. This may allow for improving identification of specific types of listening situations and thus for better adaptation to the acoustic gains 57, 58 to specific types of listening situations.

The first gain controller 32, 33 may be further adapted to control the first acoustic gain 57 in further dependence on the first noise-floor level 55, and the second gain controller 32, 33 may be further adapted to control the second acoustic gain 58 in further dependence on the second noise-floor level 56. This may allow for further improving identification of specific types of listening situations and thus for even better adaptation of the acoustic gains 57, 58 to specific types of listening situations.

The first gain controller 32, 33 may be further adapted to decrease the first acoustic gain 57 in dependence on the second noise-floor level 56 decreasing. This may allow for reducing the disturbing influence of a noise signal 18 primarily received at one ear 4 on a speech signal 18 primarily received at the other ear 5.

The second gain controller 32, 33 may be further adapted to increase the second acoustic gain 58 in dependence on the first noise-floor level 55 increasing. This may allow for further reducing the disturbing influence of a noise signal 18 primarily received at one ear 4 on a speech signal 18 primarily received at the other ear 5.

The first gain controller 32, 33 may be further adapted to decrease the first acoustic gain 57 in further dependence on the first noise-floor level 55 increasing. This may allow for further reducing the disturbing influence of a noise signal 18 primarily received at one ear 4 on a speech signal 18 primarily received at the other ear 5.

The binaural hearing aid system 1 may further comprise a noise comparator adapted to compare the first noise-floor level 55 and the second noise-floor level 56, and the second gain controller 32, 33 may be further adapted to maintain the second acoustic gain 58 in dependence on the first noise-floor level 55 exceeding the second noise-floor level 56 by more than a first predefined threshold N3, N4. This may allow for further reducing the disturbing influence of a noise signal 18 primarily received at one ear 4 on a speech signal 18 primarily received at the other ear 5.

The binaural hearing aid system 1 may further comprise a first level detector 28 adapted to determine a first signal level 53 of the first acoustic input signal 18 and a second level detector 28 adapted to determine a second signal level 54 of the second acoustic input signal 18, the first gain controller 32, 33 may be further adapted to decrease the first acoustic gain 57 in further dependence on the first signal level 53 increasing, and the second gain controller 32, 33 may be further adapted to decrease the second acoustic gain 58 in dependence on the second signal level 54 increasing. This may allow for applying a level compression to the acoustic input signals 18.

The binaural hearing aid system 1 may further comprise a level comparator 31 adapted to compare the first signal level 53 and the second signal level 54, and the binaural hearing aid system 1 may further be adapted to apply any or all of the disclosed processing of the acoustic input signals 18 in dependence on the first signal level 53 exceeding the second signal level 54. This may allow for further reducing the disturbing influence of a noise signal 18 primarily received at one ear 4 on a speech signal 18 primarily received at the other ear 5.

The first gain controller 32, 33 may be further adapted to increase the first acoustic gain 57 in further dependence on the second signal level 54 decreasing. This may allow for preserving ILDs—at least in part.

The first gain controller 32, 33 may be further adapted to increase the first acoustic gain 57 in further dependence on the first noise-floor level 55 not exceeding the second noise-floor level 56 by more than a second predefined threshold N1, N2. This may prevent attempting to preserve ILDs when ILDs may not be appropriately determined.

The first gain controller 32, 33 may be further adapted to increase the first acoustic gain 57 in further dependence on the first signal level 53 not exceeding a third predefined threshold L1, L2. This may prevent limiting and/or distortion of the acoustic output signal 23.

The second gain controller 32, 33 may be further adapted to decrease the second acoustic gain 58 in further dependence on the first signal level 53 increasing. This may also allow for preserving ILDs—at least in part.

The second gain controller 32, 33 may be further adapted to decrease the second acoustic gain 58 in further dependence on the first noise-floor level 55 not exceeding the second noise-floor level 56 by more than a fourth predefined threshold N1, N2. This may also prevent attempting to preserve ILDs when ILDs may not be appropriately determined.

The binaural hearing aid system 1 may further comprise a speech-to-noise detector 29 adapted to determine a speech-to-noise ratio SpNR for the second acoustic input signal 18, and the second gain controller 32, 33 may be further adapted to decrease the second acoustic gain 58 in further dependence on the speech-to-noise ratio SpNR exceeding a fifth predefined threshold S1, S2. This may prevent making a speech signal 18 harder to understand.

The binaural hearing aid system 1 may further comprise a first and a second filter bank, each filter bank comprising at least two band-pass filters 24 and being adapted to separate each of the first and second acoustic input signals 18 into at least two different components 34, each component 34 carrying a single frequency sub-band of the respective acoustic input signal 18, and the binaural hearing aid system 1 may be further adapted to control the acoustic gain separately for each component 34. This may allow for simultaneous processing of sound from several noise and signal sources that are separated in frequency.

The invention claimed is:

1. A method for controlling a binaural hearing aid system having a first and a second hearing aid interconnected via a communication channel, the method comprising:

receiving a first acoustic input signal by the first hearing aid;

receiving a second acoustic input signal by the second hearing aid;

determining a first noise-floor level of the first acoustic input signal;

determining a second noise-floor level of the second acoustic input signal;

controlling the first acoustic gain in dependence on the second noise-floor level;

controlling the second acoustic gain in dependence on the first noise-floor level;

applying the first acoustic gain to the first acoustic input signal to provide a first acoustic or virtually acoustic output signal;

applying the second acoustic gain to the second acoustic input signal to provide a second acoustic or virtually acoustic output signal;

outputting the first acoustic or virtually acoustic output signal via a first transducer to a first ear of a user of the binaural hearing aid system; and outputting the second acoustic or virtually acoustic output signal via a second transducer to a second ear of the user of the binaural hearing aid system.

2. A method according to claim 1 and further comprising:

decreasing the first acoustic gain in dependence on the second noise-floor level decreasing.

3. A method according to claim 1 or 2 and further comprising:

increasing the second acoustic gain in dependence on the first noise-floor level increasing.

4. A method according to claim 1 and further comprising:

decreasing the first acoustic gain in further dependence on the first noise-floor level increasing.

5. A method according to claim 1 and further comprising:

maintaining the second acoustic gain in dependence on the first noise-floor level exceeding the second noise-floor level by more than a first predefined threshold (N3, N4).

6. A method according to claim 1 and further comprising:

determining a first signal level of the first acoustic input signal;

determining a second signal level of the second acoustic input signal;

decreasing the first acoustic gain in further dependence on the first signal level increasing; and decreasing the second acoustic gain in dependence on the second signal level increasing.

7. A method for controlling a binaural hearing aid system comprising applying a method according to claim 6 in dependence on the first signal level exceeding the second signal level.

8. A method according to claim 6 or 7 and further comprising:

increasing the first acoustic gain in further dependence on the second signal level decreasing.

9. A method according to claim 8 and further comprising:

increasing the first acoustic gain in further dependence on the first noise-floor level not exceeding the second noise-floor level by more than a second predefined threshold (N1, N2).

10. A method according to claim 8 and further comprising:

increasing the first acoustic gain in further dependence on the first signal level not exceeding a third predefined threshold (L1, L2).

11. A method according to claim 6 and further comprising:

decreasing the second acoustic gain in further dependence on the first signal level increasing.

12. A method according to claim 11 and further comprising:

decreasing the second acoustic gain in further dependence on the first noise-floor level not exceeding the second noise-floor level by more than a fourth predefined threshold (N1, N2).

13. A method according to claim 11 or 12 and further comprising:

determining a speech-to-noise ratio (SpNR) for the second acoustic input signal; and decreasing the second acoustic gain in further dependence on the speech-to-noise ratio (SpNR) exceeding a fifth predefined threshold (S1, S2).

14. A method for controlling a binaural hearing aid system comprising:

separating each of the first and second acoustic input signals into at least two different components, each component carrying a single frequency sub-band of the respective acoustic input signal; and applying a method according to claim 1 to each component.

15. The method according to claim 1, wherein said controlling the first acoustic gain includes computing a gain function GF, such that $$GS1=GF(LM)-M2, \text{ where}$$

GS1 is the first acoustic gain,

GF is the gain function,

LM is a modified signal level, and

M2=β·e4(NFD), where β is a positive constant,

NFD is a noise-floor difference between the first noise-floor level and the second noise-floor level, e4=0 for NFD<N3, N3 being a first predetermined threshold, e4=(NFD−N3)/(N4−N3) for N3≤NFD<N4, N4 being another predetermined threshold greater than N3, and e4=1 for N4≤NFD.

16. The method according to claim 15, wherein the modified signal level LM is calculated according to $$LM=LL-M1,$$

wherein

LL is a local signal level, and $$M1=\alpha\cdot LD\cdot \min(e1(NFD),e2(LL),e3(SpNR)), \text{ where}$$

α is a positive constant,

LD is the signal level difference between the local signal level and a remote signal level, the min function returns a lowest value of its three arguments, SpNR is a broadband local speech-to-noise ratio, and e1, e2, e3 are enabling functions.

17. The method according to claim 16, wherein e1=1 for |NFD|<N1, e1=(N2−|NFD|)/(N2−N1) for N1≤|NFD|<N2, e1=0 for N2≤|NFD|, where N1 and N2 are predefined thresholds, e2=1 for LL<L1, e2=(L2−LL)/(L2−L1) for L1≤LL<L2, e2=0 for L2≤LL, where L1 and L2 are predefined thresholds, e3=0 for SpNR<S1, e3=(SpNR−S1)/(S2−S1) for S1≤SpNR<S2, and e3=1 for S2≤SpNR, where S1 and S2 are predefined thresholds.

18. A binaural hearing aid system, comprising:

a first hearing aid adapted to receive a first acoustic input signal and provide a first acoustic or virtually acoustic output signal;

a second hearing aid adapted to receive a second acoustic input signal and provide a second acoustic or virtually acoustic output signal;

a communication channel interconnecting the first and second hearing aids;

a first programmable filter adapted to process the first acoustic input signal to apply a first acoustic gain of the first hearing aid to the first acoustic input signal and to output the first acoustic or virtually acoustic output signal;

a second programmable filter adapted to process the second acoustic input signal to apply a second acoustic gain of the second hearing aid to the second acoustic input signal and to output the second acoustic or virtually acoustic output signal;

a first noise-floor detector adapted to determine a first noise-floor level of the first acoustic input signal;

a second noise-floor detector adapted to determine a second noise-floor level of the second acoustic input signal;

a first gain controller adapted to control the first acoustic gain in dependence on the second noise-floor level;

a second gain controller adapted to control the second acoustic gain in dependence on the first noise-floor level;

a first output transducer configured to output the first acoustic or virtually acoustic output signal to a first ear of a user of the binaural hearing aid system; and a second output transducer configured to output the second acoustic or virtually acoustic output signal to a second ear of the user of the binaural hearing aid system.

19. The binaural hearing aid system according to claim 18, wherein said first gain controller is configured to compute the first acoustic gain GS1 according to the equation GS1=GF(LM)−M2, where GS1 is the first acoustic gain, GF is the gain function, LM is a modified signal level, and M2=β·e4(NFD), where β is a positive constant, NFD is a noise-floor difference between the first noise-floor level and the second noise-floor level, e4=0 for NFD<N3, N3 being a first predetermined threshold, e4=(NFD−N3)/(N4−N3) for N3≤NFD<N4, N4 being another predetermined threshold greater than N3, and e4=1 for N4≤NFD.

20. The binaural hearing aid system according to claim 19, wherein the modified signal level LM is calculated according to $$LM=LL-M1,$$

wherein

LL is a local signal level, and $$M1=\alpha\cdot LD\cdot\min(e1(NFD),e2(LL),e3(SpNR)),\text{ where}$$

α is a positive constant,

LD is the signal level difference between the local signal level and a remote signal level, the min function returns a lowest value of its three arguments, SpNR is a broadband local speech-to-noise ratio, and e1, e2, e3 are enabling functions.

21. The binaural hearing aid system according to claim 20, wherein e1=1 for |NFD|<N1, e1=(N2−|NFD|)/(N2−N1) for N1≤|NFD|<N2, e1=0 for N2≤|NFD|, where N1 and N2 are predefined thresholds, e2=1 for LL<L1, e2=(L2−LL)/(L2−L1) for L1≤LL<L2, e2=0 for L2≤LL, where L1 and L2 are predefined thresholds, e3=0 for SpNR<S1, e3=(SpNR−S1)/(S2−S1) for S1≤SpNR<S2, and e3=1 for S2≤SpNR, where S1 and S2 are predefined thresholds.

* * * * *